US008226292B1

(12) United States Patent
Walter et al.

(10) Patent No.: US 8,226,292 B1
(45) Date of Patent: Jul. 24, 2012

(54) SUBMERSIBLE, CIRCULATION SYSTEM FOR RELATIVELY SMALL BODIES OF WATER SUCH AS A SMALL POND

(75) Inventors: Douglas P. Walter, Dickinson, ND (US); Willard R. Tormaschy, Dickinson, ND (US); Joel J. Bleth, Dickinson, ND (US); Corey M. Simnioniw, Belfield, ND (US); Allan V. Tuhy, Dickinson, ND (US); Gary A. Kudrna, Dickinson, ND (US); Jonathan L. Zent, Dickinson, ND (US)

(73) Assignee: Medora Environmental, Inc., Dickinson, ND (US)

( * ) Notice: Subject to any disclaimer, the term of this patent is extended or adjusted under 35 U.S.C. 154(b) by 560 days.

(21) Appl. No.: 12/549,962

(22) Filed: Aug. 28, 2009

Related U.S. Application Data

(60) Provisional application No. 61/093,203, filed on Aug. 29, 2008.

(51) Int. Cl.
*B01F 5/10* (2006.01)
*B01F 5/12* (2006.01)

(52) U.S. Cl. ..... 366/262; 210/170.05; 415/7; 417/61

(58) Field of Classification Search ..... 366/262–266, 366/270; 261/91, 120; 417/61; 415/7; 210/170.01–170.11, 121, 242.1–242.4, 220–221.2
See application file for complete search history.

(56) References Cited

U.S. PATENT DOCUMENTS 2,991,622 A * 7/1961 Oster ..... 405/61
5,256,309 A 10/1993 Makino
6,241,221 B1 * 6/2001 Wegner et al. ..... 261/93
6,432,302 B1 * 8/2002 Obritsch et al. ..... 210/170.05
6,439,853 B2 * 8/2002 Tormaschy et al. ..... 417/53
6,533,496 B1 3/2003 Elliott
7,285,208 B2 * 10/2007 Tormaschy et al. ..... 210/170.05
7,306,719 B2 * 12/2007 Tormaschy et al. ..... 210/170.05
7,331,569 B2 * 2/2008 Reusche et al. ..... 261/36.1
7,332,074 B2 2/2008 Tormaschy et al.
7,517,460 B2 * 4/2009 Tormaschy et al. ..... 210/754
7,641,792 B2 * 1/2010 Tormaschy et al. ..... 210/198.1

(Continued)

FOREIGN PATENT DOCUMENTS

FR 2825082 A1 * 11/2002

*Primary Examiner* — Charles E Cooley
(74) *Attorney, Agent, or Firm* — W. Scott Carson

(57) ABSTRACT

A submersible, circulation system for small and shallow bodies of water such as a small pond. The system includes a driving unit with a tubular shell member and a base member and has a submersed motor and pump supported therein. The shell member extends along and about a vertical axis and has upper and lower openings with the base member spaced below and extending across the lower opening to create inlets therebetween. The pump draws water horizontally through the inlets into the unit where a relatively small first portion of the incoming water enters the pump and is driven downwardly and out upwardly directed discharge nozzles. The discharged flow passes through the remaining portion of the incoming flow to induce the larger, remaining portion to move upwardly with it toward the pond surface in a non-turbulent manner to raise the pond surface into a slightly convex mound. Gravity subsequently collapses the mound in a repeating process to create a pattern of substantially laminar, surface waves outwardly to the pond edges, down the pond sides, and back into the driving unit.

41 Claims, 12 Drawing Sheets

U.S. PATENT DOCUMENTS

| | | | | |
|---|---|---|---|---|
| 7,670,044 | B2 * | 3/2010 | Tormaschy et al. | 366/264 |
| 7,789,553 | B2 * | 9/2010 | Tormaschy et al. | 366/262 |
| 7,798,784 | B2 * | 9/2010 | Tormaschy et al. | 417/61 |
| 7,850,433 | B2 * | 12/2010 | Tormaschy et al. | 417/61 |
| 7,906,017 | B2 * | 3/2011 | Tormaschy et al. | 210/170.05 |
| 7,934,705 | B2 * | 5/2011 | Sun et al. | 261/87 |
| 7,967,498 | B2 * | 6/2011 | Van Den Berg | 366/136 |
| 8,057,091 | B2 * | 11/2011 | Tormaschy et al. | 366/264 |
| 2002/0001529 | A1 * | 1/2002 | Tormaschy et al. | 417/423.9 |
| 2005/0061721 | A1 * | 3/2005 | Tormaschy et al. | 210/121 |
| 2005/0142011 | A1 * | 6/2005 | Tormaschy et al. | 417/423.15 |
| 2005/0155922 | A1 * | 7/2005 | Tormaschy et al. | 210/241 |
| 2007/0295672 | A1 * | 12/2007 | Tormaschy et al. | 210/754 |
| 2008/0000818 | A1 * | 1/2008 | Tormaschy et al. | 210/121 |
| 2008/0002517 | A1 * | 1/2008 | Tormaschy et al. | 366/142 |
| 2008/0047497 | A1 * | 2/2008 | Reusche et al. | 119/69.5 |
| 2008/0049547 | A1 * | 2/2008 | Reusche et al. | 366/142 |
| 2008/0087586 | A1 * | 4/2008 | Tormaschy et al. | 210/85 |
| 2008/0087610 | A1 * | 4/2008 | Tormaschy et al. | 210/747 |
| 2008/0112820 | A1 * | 5/2008 | Tormaschy et al. | 417/61 |
| 2008/0128344 | A1 * | 6/2008 | Tormaschy et al. | 210/170.05 |
| 2008/0169229 | A1 * | 7/2008 | Tormaschy et al. | 210/170.05 |
| 2009/0134083 | A1 * | 5/2009 | Tormaschy et al. | 210/198.1 |
| 2010/0092285 | A1 * | 4/2010 | Tormaschy et al. | 415/211.2 |
| 2010/0109170 | A1 * | 5/2010 | Sun et al. | 261/87 |
| 2010/0236647 | A1 * | 9/2010 | Simnioniw et al. | 137/565.01 |
| 2011/0129338 | A1 * | 6/2011 | Tormaschy et al. | 415/211.2 |
| 2012/0067799 | A1 * | 3/2012 | Simnioniw et al. | 210/170.05 |

* cited by examiner

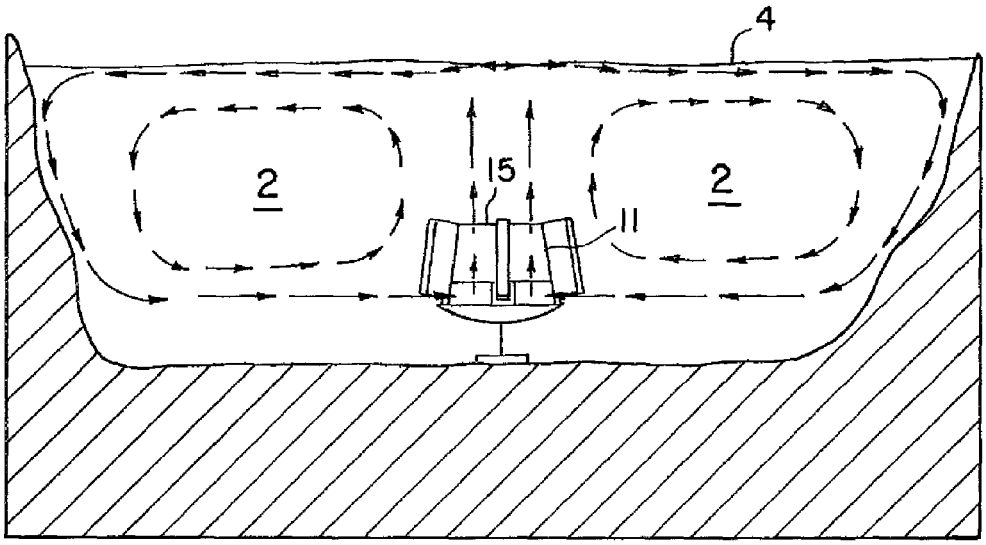
Fig. 4a
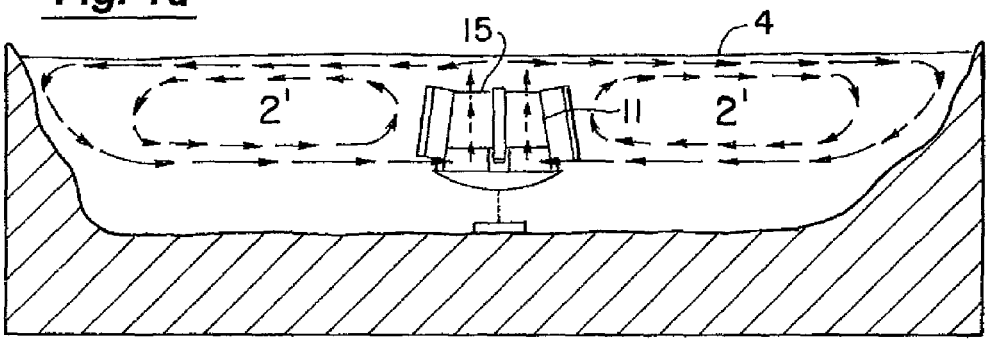
Fig. 4b
Fig. 4c
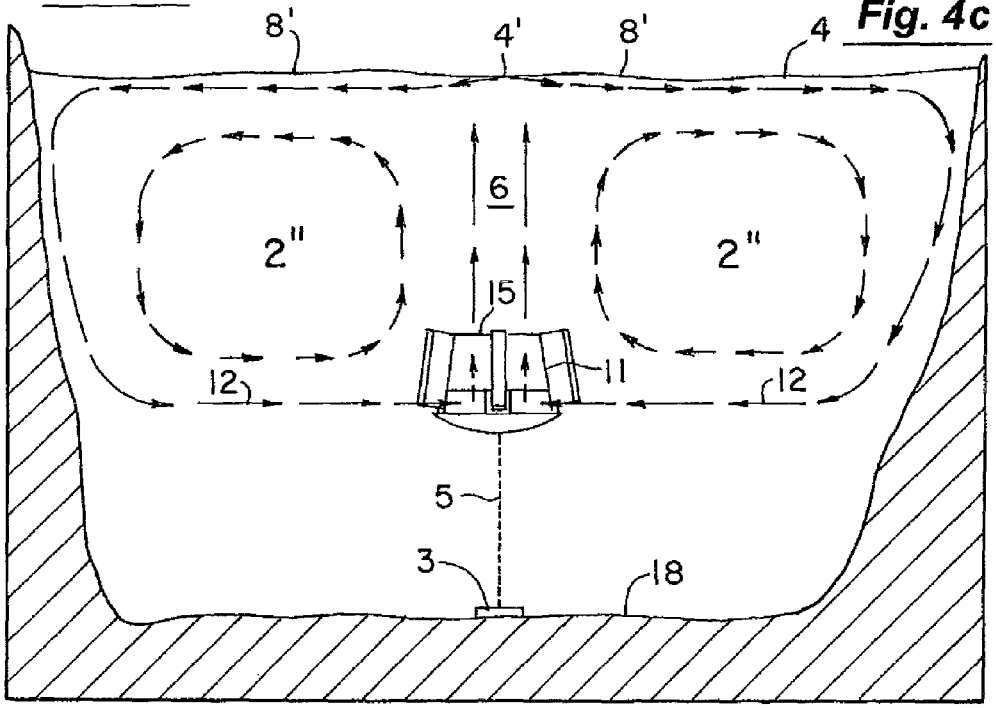

SUBMERSIBLE, CIRCULATION SYSTEM FOR RELATIVELY SMALL BODIES OF WATER SUCH AS A SMALL POND

RELATED APPLICATIONS

This application claims the benefit of U.S. Provisional Patent Application Ser. No. 61/093,203 filed Aug. 29, 2008, which is incorporated herein by reference.

BACKGROUND OF THE INVENTION

1. Field of the Invention

This invention relates to the field of circulation systems for bodies of water and more particularly to such circulation systems for relatively small and shallow bodies of water such as a small pond as well as relatively small portions of larger bodies of water such as at boat marinas and lake coves.

2. Discussion of the Background

Relatively small and shallow bodies of water often experience water quality issues related to the lack of thorough circulation. For many such bodies, water movement caused by wind, water currents, water run off, and other natural occurrences are simply not adequate enough to beneficially circulate the water.

Poor water quality of such bodies can significantly reduce the property values for those who own or live near the surrounding land; however, more importantly, it can lead to health problems for those who use the water body for work or recreation as well as animals that rely on it. Many human and animal health concerns have been traced to a number of water quality issues such as harmful algae blooms, invasive weeds, and low dissolved oxygen levels. For water bodies that are lacking thorough circulation from natural causes, additional circulation is needed to reduce and in many cases eliminate a stagnate water situation which can dramatically contribute to poor and unhealthy water quality.

A number of prior mixing and aeration systems have operated under the principle of rapid, turbulent flow patterns. However, it has been observed that this type of mixing has a relatively small zone of circulation influence around the mixer or aerator. Consequently, to achieve a thorough circulation of the entire water body with this approach, the mixer or aerator must be relatively large with high power requirements or there must be a relatively large number of such machines to do the job. Observations have suggested that a preferred approach to such turbulent machines is to provide a circulator that can create a nearly laminar, surface flow pattern out to the edges of the water body while drawing up water from the depths of the body. Economic and safety considerations generally dictate that such nearly laminar flow circulators have low voltage and power requirements while esthetic considerations in certain situations (e.g., residential or golf course ponds) dictate that the circulator preferably be completely submersible to be out of view.

In these regards, a circulation system operating on a relatively low voltage and power demand poses less risk of electrocution or injury to owners, residents, and users of the water body as well as to any animals that rely on it. Additionally, for a water body such as a residential or golf course pond, a completely submerged circulator is desirable to give the pond a pristine, natural look. The submerged circulator including its components and operation are then preferably undetectable even at close distances; however, the submersible circulator must still be capable of thoroughly circulating the deep water as well as the surface water. Without circulation of the surface water, a thin film or cover becomes established and blocks exposure to the oxygen rich atmosphere and the effectiveness of circulating the water is greatly diminished. Previous devices in this field of circulating systems have addressed this surface renewal issue but have had to do so using a floating platform and dish. The platform and flotation for it are above the waterline and where it is desired that no part of the circulator be visible to destroy the natural setting of the water, these floating systems are unacceptable.

An additional benefit of having a submersible system in contrast to one that has components above the surface is that harmful and noticeable fouling by birds or other animals is prevented. Less maintenance is then required to keep the circulator working and the pond or other body of water looking pristine. Also, vandals are less likely to notice a submerged circulation system and damage or steal it.

Thus, in a well-designed system for relatively small and shallow bodies of water as indicated above, the surface of the pond or other body of water would be continually renewed with water drawn up from the bottom depths. Further, this would be done while maintaining a substantially laminar surface flow out to the edges of the pond. The surface water would then absorb oxygen from the atmosphere while undesirable gases such as hydrogen sulfide would pass out of the water into the atmosphere. The circulator would also preferably have relatively low voltage and power requirements and be completely submersible to be totally out of view.

With these and other desirable characteristics in mind, the submersible circulation system of the present invention was developed. With it, a nearly laminar surface flow out to the edges of the water body is created while uplifting water from the bottom or lower depths of the pond for treatment. In doing so, the oxygen depleted water from the bottom depths is exposed to the atmosphere to absorb oxygen from it and undesirable gases such as hydrogen sulfide are passed off into the atmosphere. Additionally, the current invention generates an overall circulation pattern that mixes the re-aerated water throughout the body of water to aid and accelerate the biological and solar processes that clean up the water. The resulting cleansing is particularly effective in controlling or removing weed growth, algae blooms, sludge buildup, fish kills, odors, high amounts of nitrogen and phosphorous, acidity, suspended solids, and other undesirable conditions. In a modified embodiment, a small surface float is used with the system while still maintaining and achieving the desired circulation benefits discussed above.

SUMMARY OF THE INVENTION

This invention involves a submersible, circulation system for relatively small and shallow bodies of water such as a small pond or relatively small and shallow portions of larger bodies of water. The system includes a driving unit having a substantially tubular shell member and a base member with a submersed motor and pump supported within the unit. The tubular shell member extends along and about a substantially vertical axis and has upper and lower openings. The base member extends substantially across the lower opening and is spaced below it to create inlets between the shell and base members into the unit.

In use, the driving unit of the circulation system is completely submerged below the pond surface and essentially invisible so as not to detract from the natural setting of the pond. The unit has low voltage and power requirements for economical operation and safety yet establishes an overall circulation pattern in the pond. In a continuous process, the pump of the system draws water substantially horizontally from outside the submerged driving unit through the inlets into the unit. A first portion of the incoming water enters the pump and is driven downwardly through the pump and out upwardly directed discharge nozzles. The discharged water is directed vertically upwardly through or across the remaining portion of the incoming flow and upwardly out the upper opening of the shell member toward the pond surface. In passing and crossing through the incoming flow, the discharged water from the pump nozzles induces the remaining portion of the incoming flow not drawn into the pump inlet to move upwardly with it toward the pond surface.

The first portion of the continuous incoming flow entering the pump in effect is redirected by the pump to circle back on itself as a faster moving flow. The redirected flow then passes within the driving unit through the remaining portion of the incoming flow not drawn into the pump inlet and induces the remaining portion to move with it upwardly to the pond surface.

At the pond surface, the upwardly directed and induced flow preferably is non-turbulent and does not break or only minimally breaks the pond surface. Rather, the upward flow merely lifts or raises the pond surface into a slightly convex mound or crown. Gravity then collapses the raised mound and in a repeating manner, a pattern of substantially laminar, surface waves is set off radiating outwardly to the pond edges. The water then travels down the sides of the pond and is drawn substantially horizontally into the driving unit to establish an overall, nearly laminar circulation pattern in the pond between its surface and the depth setting of the inlets to the driving unit.

In a modified embodiment, a small surface float is used with the system. Although the small surface float is visible, the driving unit is still completely submerged and the desired circulation benefits are still achieved.

BRIEF DESCRIPTION OF THE DRAWINGS

FIGS. 4*a*-4*c* show how the circulation system can be adapted for use in ponds of various depths.

DETAILED DESCRIPTION OF THE INVENTION

Figure 1:
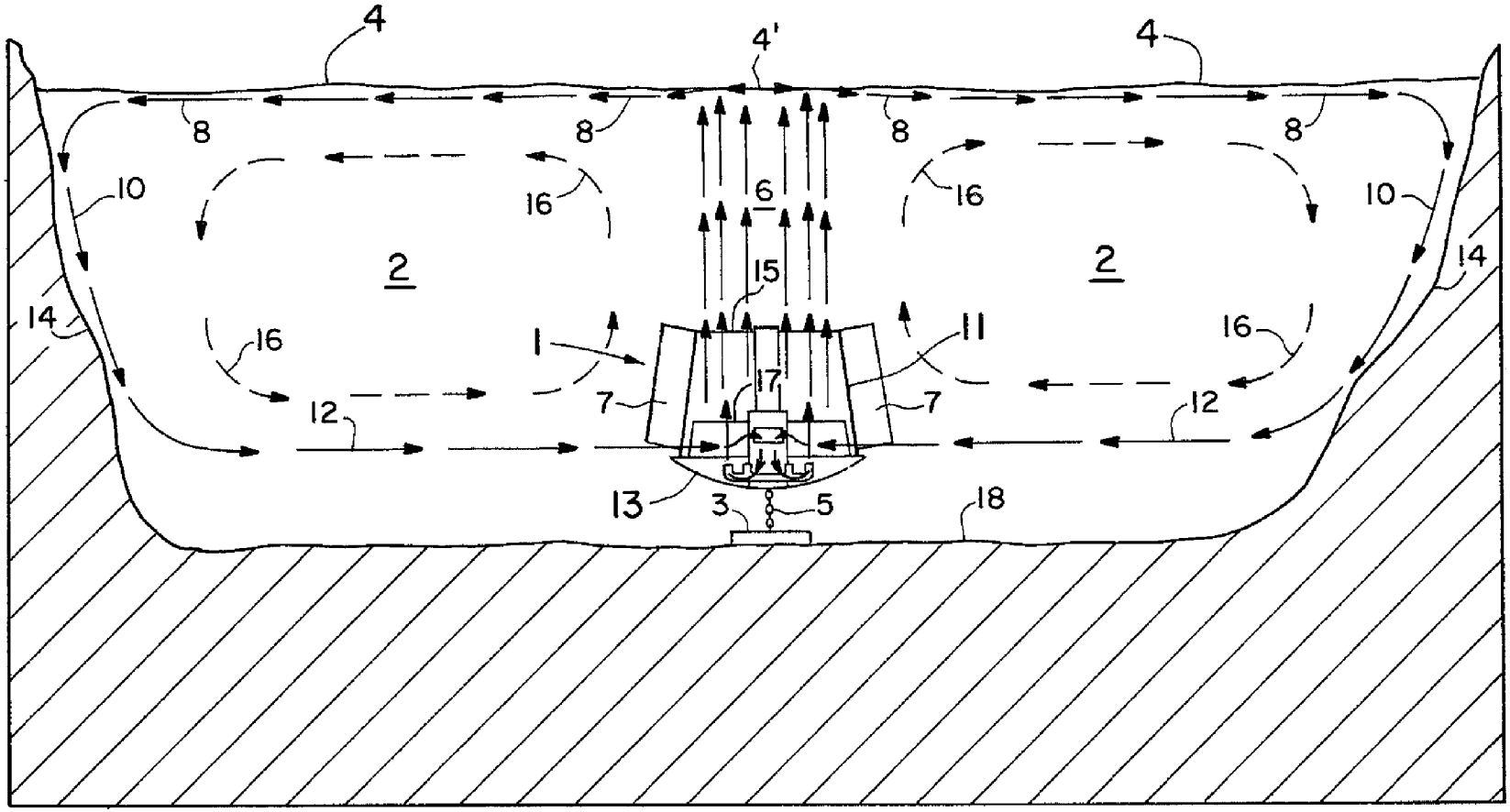
FIG. 1 is a cross-sectional view of the circulation system of the present invention for a relatively small and shallow body of water such as a small pond in which the system creates an overall circulation pattern in the pond.
Figure 2:
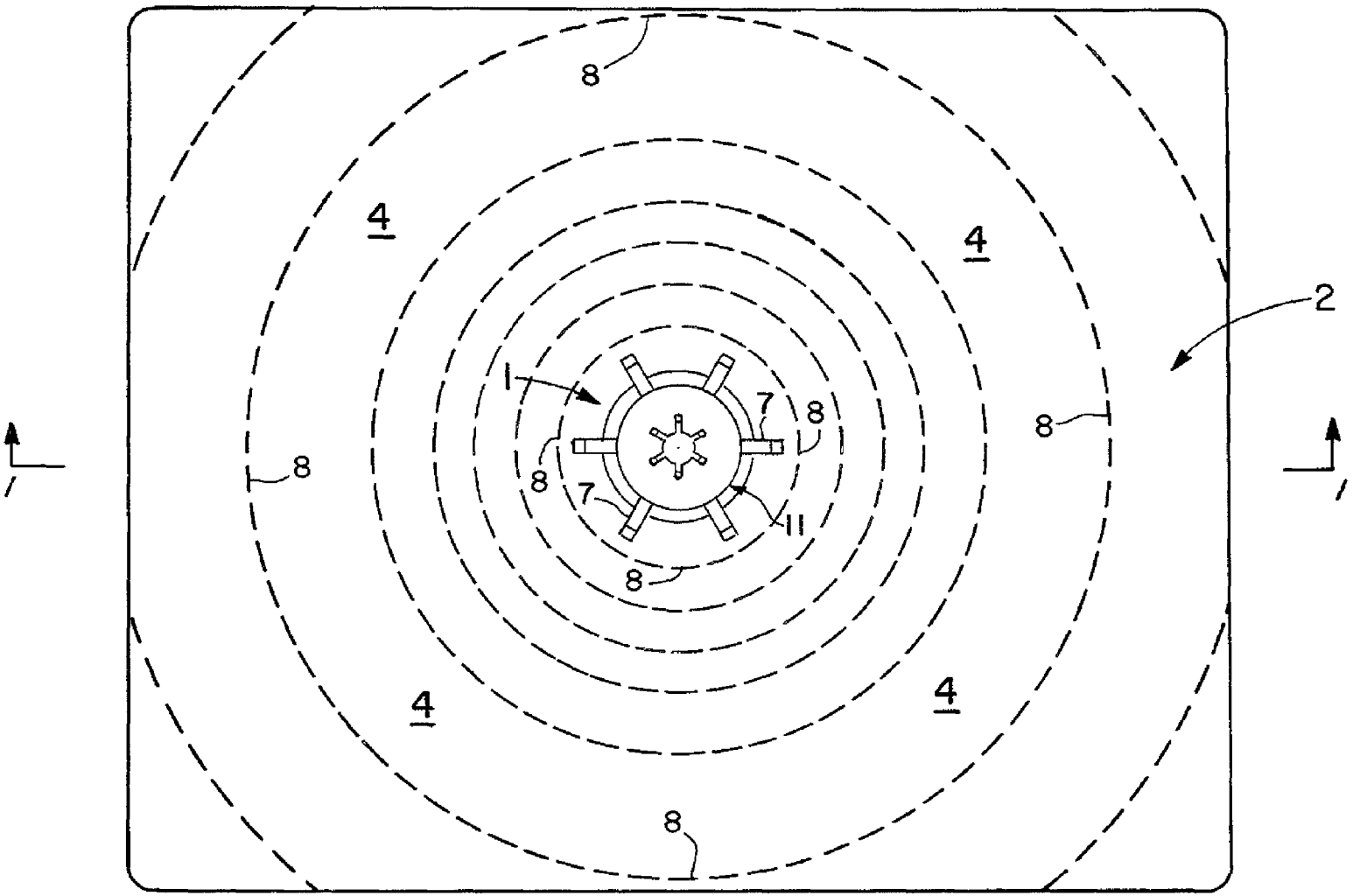
FIG. 2 is a plan view of the circulation system of FIG. 1 illustrating the substantially laminar wave pattern created by the system in the surface of the pond out to its edges.

The circulation system of the present invention as illustrated in FIG. 1 is designed for use in relatively small (e.g., 1-3 acres) and shallow (e.g., 5-15 feet) bodies of water such as a small pond 2. The system can also be operated in relatively small and shallow portions of larger bodies of water such as at boat marinas and lake coves. In use as shown in FIG. 1, the driving unit 1 of the system is submerged below the surface 4 of the pond 2 and establishes an overall circulation pattern 6, 8, 10, and 12 in the pond 2. In this regard, the overall circulation pattern extends upwardly at 6 from the submerged driving unit 1 to the pond surface at 4'. The pattern then flows substantially radially outwardly at 8 (see also FIG. 2) along the surface 4 to the pond edges, downwardly at 10 in FIG. 1 along the pond sides 14, and substantially radially horizontally inwardly at 12 toward the driving unit 1. This overall circulation pattern of 6, 8, 10, and 12 in the pond 2 established by the driving unit 1 in turn induces secondary flow patterns in the pond 2 such as at 16 in FIG. 1 to then thoroughly mix the water in the entire pond 2.

Figure 3A:
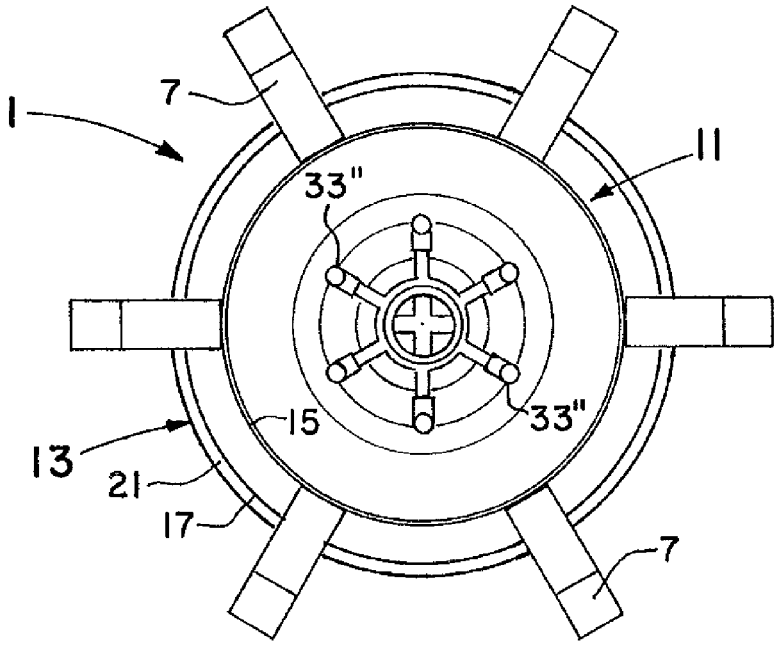
FIGS. 3*a*-3*f* illustrate details of the circulation system including its driving unit with its tubular shell member and downwardly convex, dish-shaped base member.
Figure 3B:
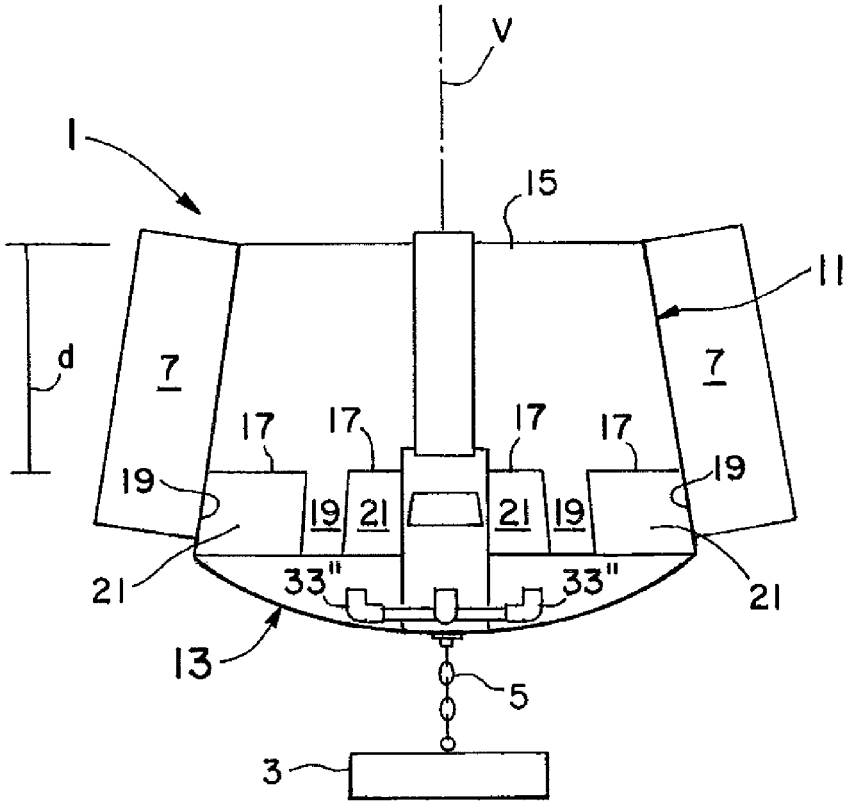

The driving unit 1 as shown in FIG. 1 is anchored by the weight 3 and chain attachment 5 with the weight 3 preferably resting on the pond bottom 18. The driving unit 1 is then buoyed upwardly by the floats 7 (see FIGS. 1-2 and 3*a*-3*f*) attached adjacent to the exterior surface (FIG. 3*b*) or interior surface (FIG. 3*f*) of the tubular shell member 11. The driving unit 1 as illustrated in FIGS. 1 and 3*b* includes the substantially tubular shell member 11 and the downwardly convex, dish-shaped base member 13 (see also FIG. 3*c*). The preferred shape of the tubular shell member 11 (FIGS. 3*b*-3*c*) is a truncated cone that is slightly inclined upwardly toward the substantially vertical axis V at about 5-15 degrees. The inclination in this regard adds a slight acceleration to the flow exiting through the upper opening at 15 of the shell member 11.

Figure 3C:
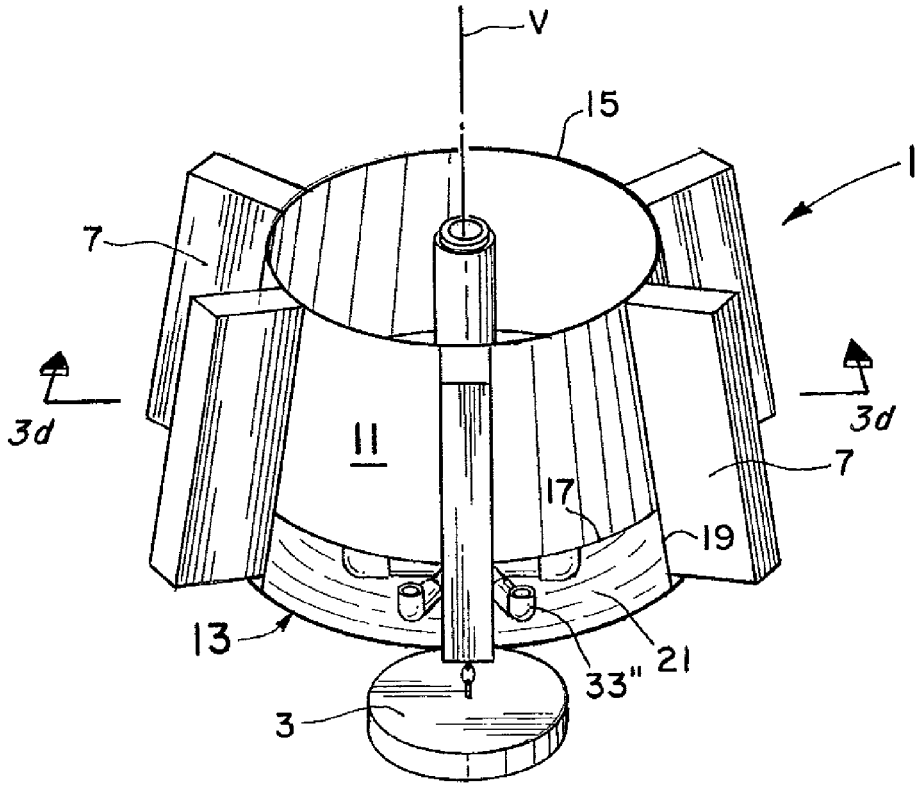
Figure 3D:
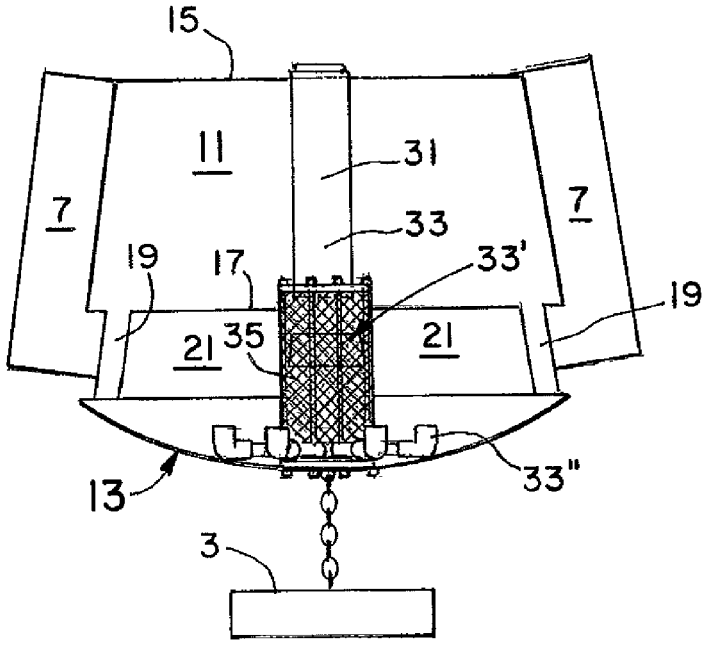
Figure 3E:
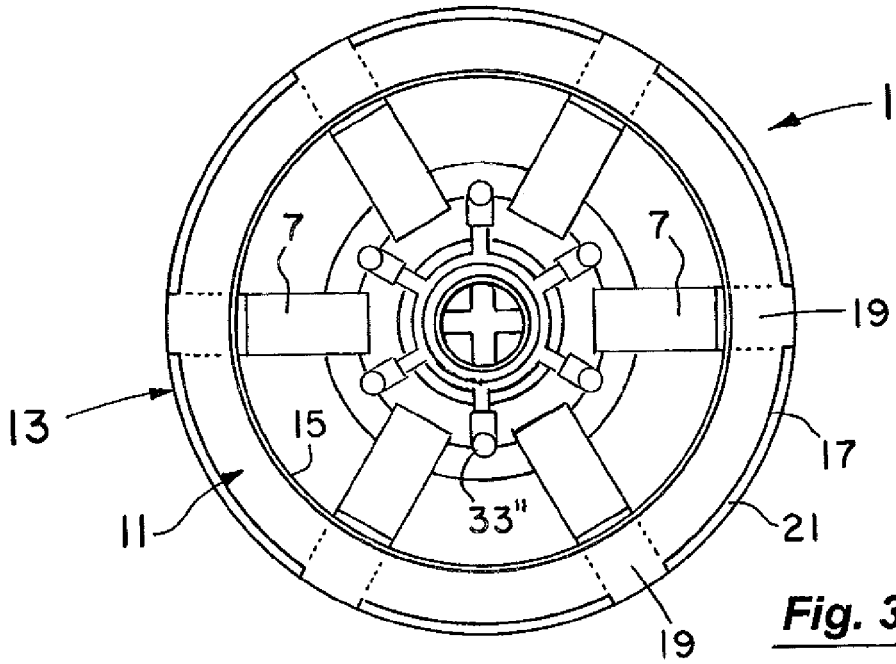
Figure 3F:
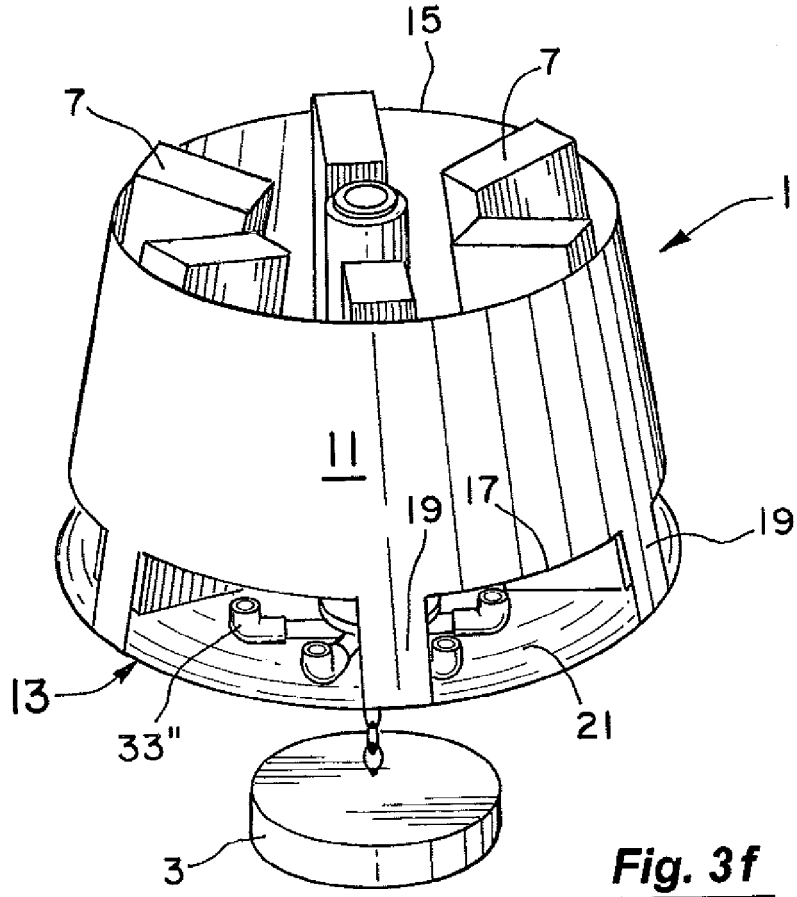

The shell member 11 (FIG. 3*b*) is spaced from the vertical axis V and extends thereabout. The shell member 11 also extends for a first distance d (e.g., 20 inches in FIG. 3*c*) along the vertical axis V between the upper and lower end sections 15,17 of the shell member 11. The upper and lower end sections 15,17 form respective upper and lower, substantially circular openings extending about the vertical axis V (FIGS. 3*b*-3*c*). The base member 13 (FIGS. 1 and 3*b*-3*c*) extends substantially across the lower opening at 17 of the shell member 11 and is supported by legs 19 (FIGS. 3*b*, 3*d*, and 3*f*) in a position spaced below the shell member 11. In this manner, an inlet or inlets 21 are created between the shell member 11 and base member 13 into the driving unit 1. Preferably, there is an inlet 21 between each support leg 19 (to which the floats 7 can also be attached) but there can be a single inlet 21 extending partially or substantially completely around the vertical axis V if desired. The area of the pump inlet 33' can also have a protective debris screen such as 35 in FIG. 3*d* if desired.

The driving unit 1 of the circulation system can be set at a number of different depth locations in the ponds 2, 2', and 2" of FIGS. 4*a*-4*c*. In FIG. 4*a*, the top or upper opening at 15 of the tubular shell member 11 is shown set at about 18 inches below the surface 4 of the pond 2. In FIG. 4*b*, the top at 15 is about 4 inches below the surface 4 of pond 2' and about 40 inches in FIG. 4*c* below the surface of pond 2". The depth of the top or upper opening at 15 of the shell member 11 is preferably positioned in any particular pond to remain in the 4-40 inch range regardless of water depth changes due to use or weather (e.g., rain, run off, or evaporation). The chain 5, cable, or other attaching means for the anchor 3 is preferably adjustable. In this manner, the top at 15 of the shell member 11 can then be positioned to be no deeper than a desired depth (e.g., about 40 inches in the illustrated embodiments such as in FIG. 4*c*) with the anchor 3 resting on the pond bottom 18. The driving unit 1 as illustrated in FIG. 4*c* draws water at 12 substantially horizontally inwardly and establishes the lower boundary of the water in the overall circulation pattern of the pond.

Figure 5:
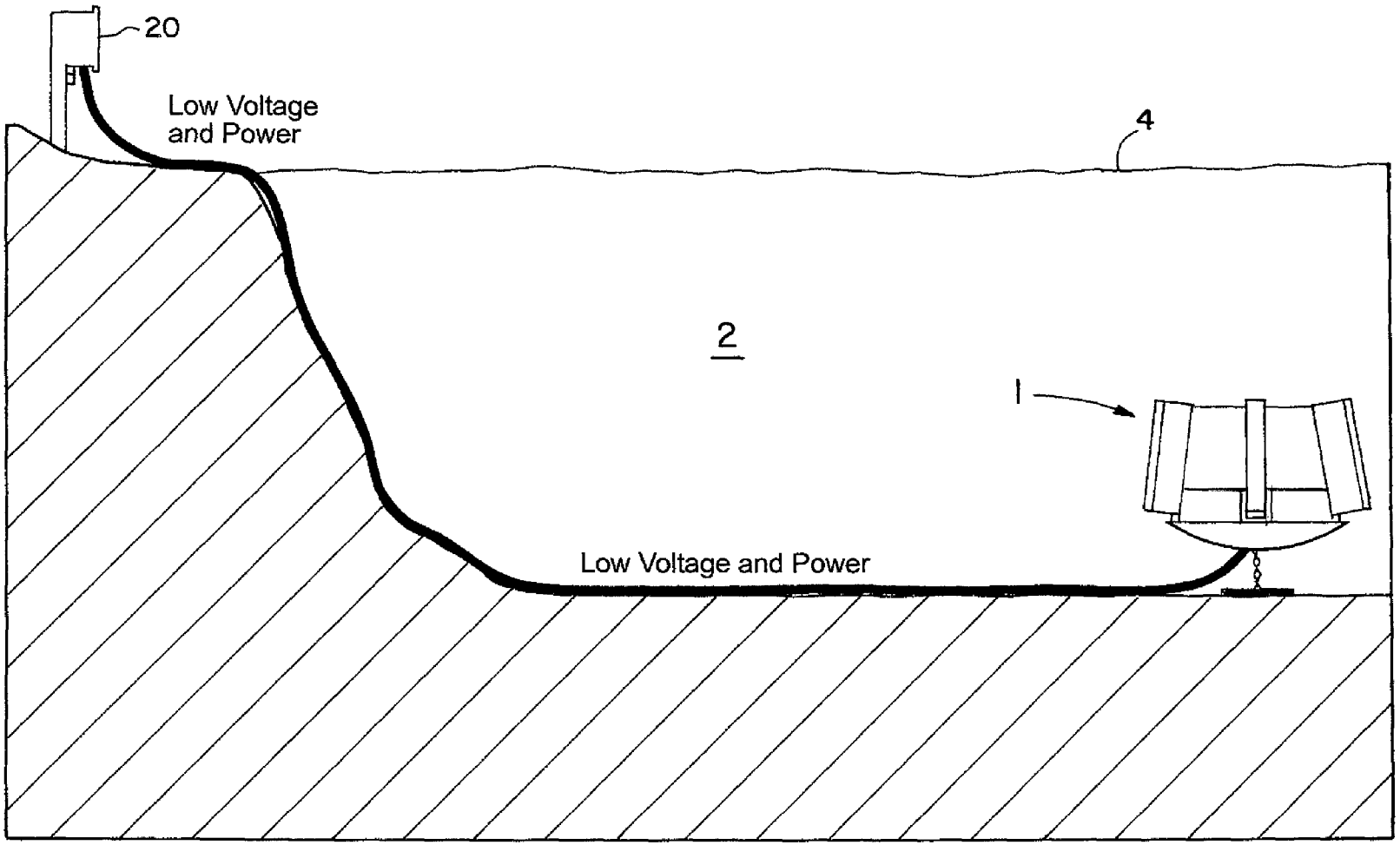
FIG. 5 illustrates that the circulation system including its driving unit is completely submerged and is essentially invisible so as not to detract from the natural setting of the pond.

In use as shown in FIG. 5, the driving unit 1 of the circulation system is completely submerged below the surface 4 of the pond 2. The unit 1 is essentially invisible so as not to detract from the natural setting of the pond 2. The driving unit 1 also has relatively low voltage (e.g., 48 volts AC) and power (e.g., 500 watts) requirements for economical operation and safety. Such requirements can normally be easily met at most locations as the unit 1 can be run directly off the local electrical grid at 20 or from solar panels if desired.

Figure 6:
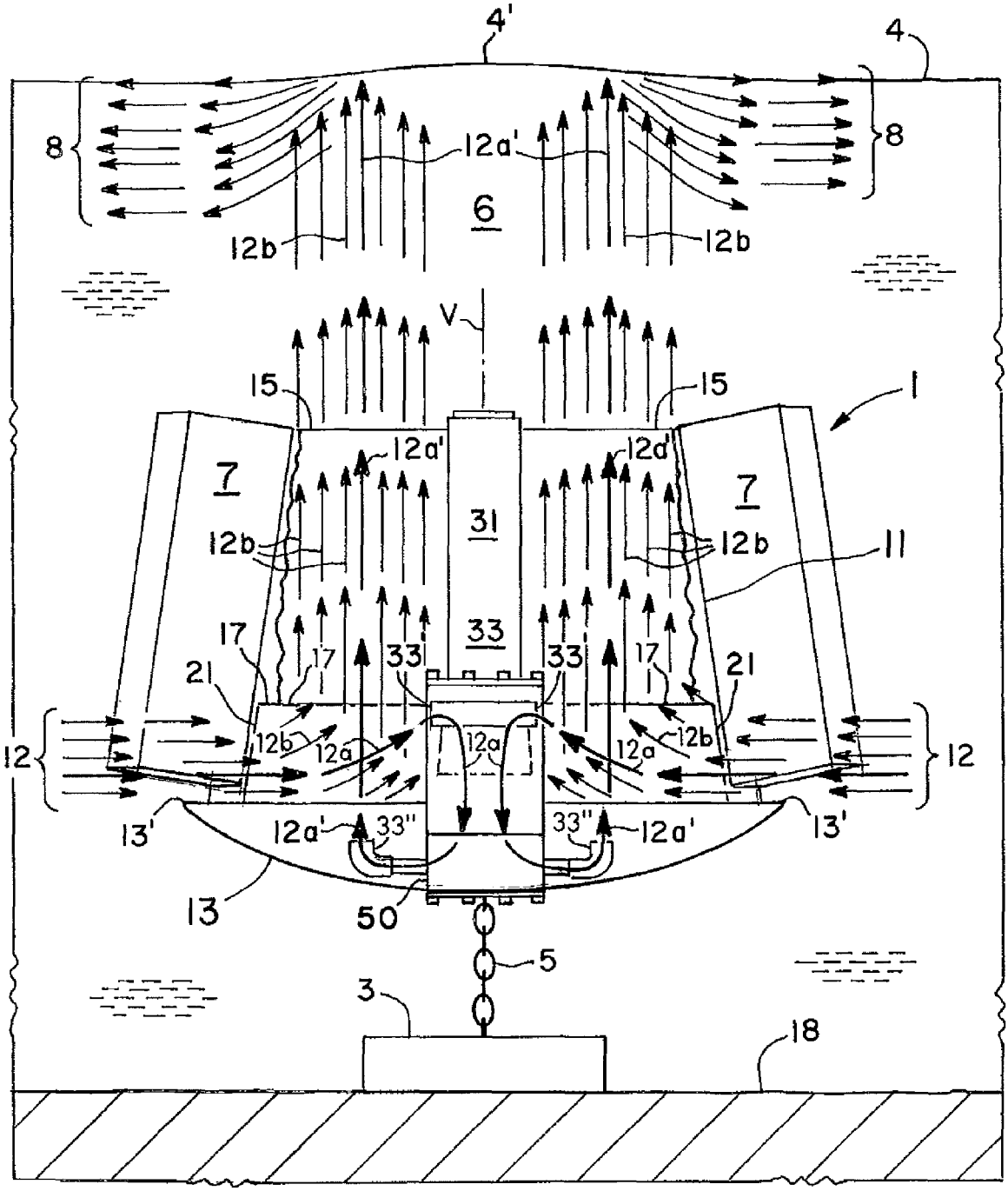
FIG. 6 is a cross-sectional view of the driving unit and its operational parts and flows.

The operation of the driving unit 1 of the system as indicated above creates the desired, overall circulation patter 6, 8, 10, 12 of FIG. 1 in the pond 2. In doing so, the unit 1 uses a motor 31 (FIG. 6) to drive a pump 33. The pump 33 continuously draws water at 12 in FIG. 6 from outside the unit 1 substantially horizontally inwardly through the inlets 21 into the unit 1. A portion 12*a* of the incoming flow 12 is then sucked into and enters the pump inlets 33' (FIG. 6). The portion 12*a* is thereafter driven downwardly through the pump 33 and out the upwardly directed discharge nozzles 33" at 12*a'*.

A single nozzle 33" can be used with a single inlet 21 but the preferred design as illustrated has a plurality of inlets 21 and a manifold (FIG. 3*a*) with a plurality of nozzles 33" (i.e., openings) spaced about the vertical axis V creating the flow 12*a'* of FIG. 6. The discharge nozzles 33" as illustrated are preferably positioned in the base member 13 beneath the level of the incoming flow 12. That is, the bottom of each inlet 21 in FIG. 6 at the level of the perimeter edge 13' of the base member 13 sets the lower level of the substantially horizontal incoming flow 12. The perimeter edge 13' extends about the vertical axis V substantially in a horizontal plane. Each nozzle 33' is preferably positioned in the base member 13 below the horizontal plane and beneath the incoming flow. The discharged water 12*a'* from the nozzles 33" in FIG. 6 is then directed substantially vertically upwardly within the unit 1 along the vertical axis V. The discharge flow 12*a'* within the unit 1 passes through or across the incoming flow and by the inlets 21. The flow 12*a'* thereafter continues upwardly out the upper opening at 15 of the shell member 11 along the path 6 toward the pond surface at 4'. In passing and crossing through the incoming flow to the unit 1, the discharged water 12*a'* from the nozzles 33" induces the remaining portion 12*b* not drawn into the pump inlets 33' to move upwardly with it toward the pond surface at 4'.

In a continuous process, the portion 12*a* of the incoming flow 12 in effect has been redirected by the pump 33 to circle back on itself as the faster moving flow 12*a'*. The redirected flow 12*a'* thereafter passes within the unit 1 through the remaining portion 12*b* of the incoming flow 12 not drawn into the pump 33. The flow 12*a'* then induces the remaining flow 12*b* to move with it upwardly as part 6 of the overall circulation pattern 6, 8, 10, and 12 of FIG. 1. Part 6 in this regard and as shown in FIGS. 1 and 6 is unrestricted above the tubular shell member 11 (e.g., open to the surrounding water and not confined as by a draft tube) and forms an unconfined, upwardly directed current or column in the body of water 2 (FIG. 1).

One benefit of the passing through or cross mixing of flows 12*a'* and 12*b* as illustrated in FIG. 6 is to reduce any turbulence in the flow 12*a'* as discharged from the nozzles 33" before it reaches the pond surface at 4'. That is, the higher rate (e.g., 2 feet/second) of the discharged flow 12*a'* at the nozzles 33" primarily drives the overall circulation pattern in the pond 2. However, any turbulence in the discharged flow 12*a'* from nozzles 33" preferably is dampened before reaching the pond surface at 4'. The passing through or cross mixing with the slower moving (e.g., less than one foot/second) and larger volume (e.g., 5:1) flow 12*b* will then effectively do this.

To aid in keeping any turbulence to a minimum in the mixing area where the flow 12*a'* crosses through the remaining flow 12*b*, the pump inlets 33' are preferably positioned at a vertical level near the upper part of the inlets 21 (FIG. 6). The incoming flow of 12*a* and 12*b* is then diverted or curved slightly upwardly by the pump 33 as the portion 12*a* is drawn into the pump inlets 33'. The redirected flow 12*a'* can then more easily induce the remaining flow not drawn into the pump 33 to move upwardly with it. The redirecting of the flow at 12*a'* and passing it through the remaining flow portion 12*b* have also been observed to push any debris in the incoming flow 12 upwardly away from the pump inlets 33'. This helps to avoid having any such debris accumulate on the pump strainer 35 or get stuck inside the pump 33.

The result of the operation of the driving unit 1 is that a relatively small volume of water 12*a* passes through the pump 33 and is discharged as 12*a'* at a higher rate to induce a larger volume (e.g., at least about 2:1 and preferably 5:1 or more ratio) of water 12*b* to move upwardly with it to the pond surface at 4' in a non-turbulent manner. The upwardly directed flow 6 from the driving unit 1 (see FIGS. 1 and 4*c*) preferably does not break (or only minimally breaks) the surface at 4'. Rather, the flow 6 merely lifts or raises the pond surface at 4' (perhaps best seen in FIG. 4*c*) a few inches or fractions of an inch (e.g., ¼-½) into a slightly convex mound or crown. Gravity then collapses the raised mound and in a repeating manner, a pattern of substantially laminar, surface waves 8' as in FIG. 4*c* is generated radiating outwardly to the pond edges. As discussed above, such non-turbulent action has been observed to produce substantially laminar surface waves such as 8' that will propagate much farther (e.g., 300 feet or more) than waves created from a turbulent breaking or bubbling of the pond surface 4.

A substantially complete, nearly laminar mixing of the pond is then possible even with a relatively short and small driving unit 1 (e.g., 2 feet high by 2 feet wide) operated with a relatively low voltage (e.g., 48 VAC) and power (e.g., 500 watts) requirement. The submerged system is essentially invisible and the gentle surface waves are so small as to be nearly undetectable and normally are not a visual distraction to a viewer. Also, in contrast to larger circulation systems requiring special hoisting equipment or assembly tools, the relatively light (e.g., 40 pounds) and small driving unit 1 can usually be manually installed with or without the aid of a small boat or other vessel.

Figure 8:
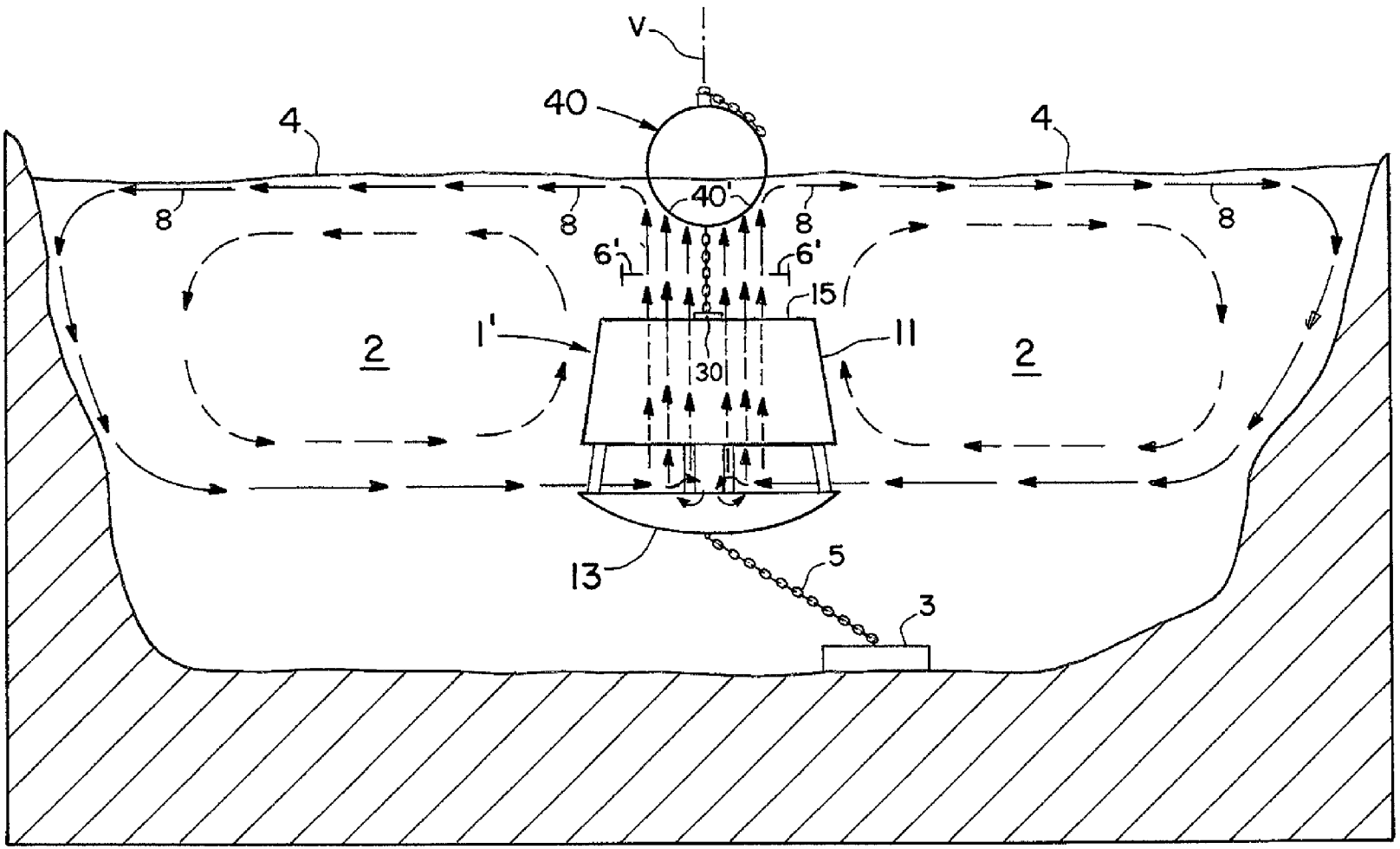
FIG. 8 illustrates a modified embodiment in which a small surface float is used in place of the floats positioned in the submerged driving unit of the prior embodiments.

FIG. 8 illustrates a modified embodiment in which the submerged floats 7 attached to the tubular shell member 11 of the prior embodiments are replaced by a small surface float 40. The surface float 40 can be a spherical float such as shown wherein the driving unit 1 (e.g., 40-50 pounds) is then suspended from the surface float 40. In operation, the upwardly directed water from the tubular shell member 11 strikes the lower, substantially hemispherical or other substantially convex surface 40' of the surface float 40 and is uniformly deflected by the submerged surface 40' outwardly of and about the vertical axis V. The deflected water then establishes a surface pattern essentially the same as 8 in FIG. 2.

More specifically as shown in FIG. 8, water is directed upwardly through the upper opening at 15 of the tubular shell member 11 of the driving unit 1 along a substantially vertical flow path toward the surface 4 of the body of water 2. The portion of this upwardly directed flow at 6' in FIG. 8 above the submerged tubular shell member 11 is unrestricted (e.g., open to the surrounding water and not confined as by a draft tube). In this manner, the flow at 6' forms an unconfined, upwardly directed current or column in the body of water 2 wherein the small surface float 40 (e.g., 13 inch diameter) is then positioned in this upward current 6' to uniformly direct the water therein outwardly of and about the vertical axis V. The visible surface float 40 of this embodiment also helps to more easily locate the position of the submerged driving unit 1 in the pond if, for example, repairs or adjustments need to made to the unit 1. This surface float embodiment also serves to set the driving unit 1 more or less at a fixed depth (e.g., 4-5 feet to the base 13) regardless of fluctuations in the total depth of the pond.

Figure 9B:
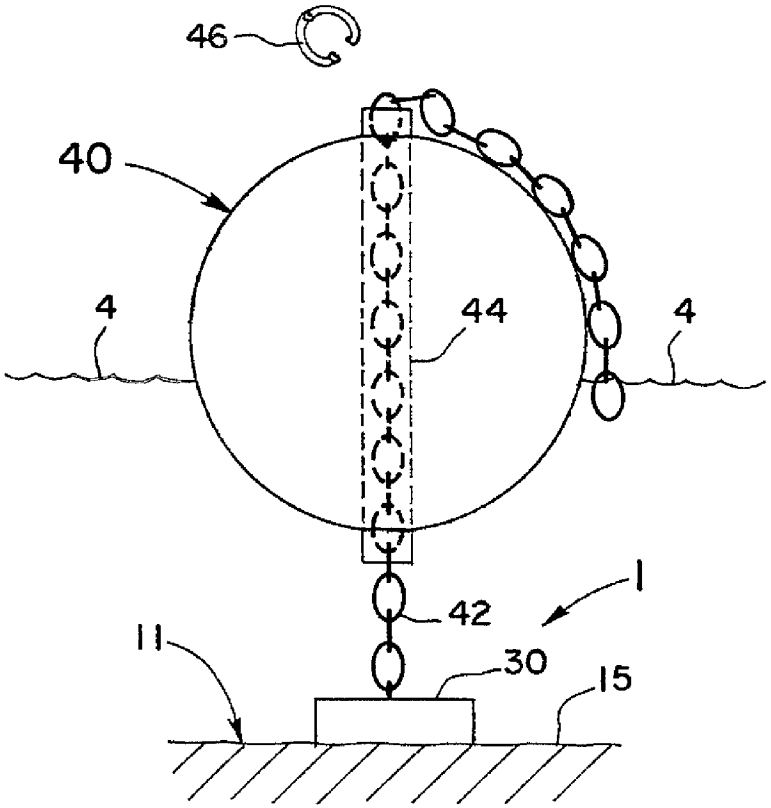
FIGS. 9*a* and 9*b* show how the depth of the submerged driving unit can be vertically adjusted in the embodiment of FIG. 8.
Figure 9A:
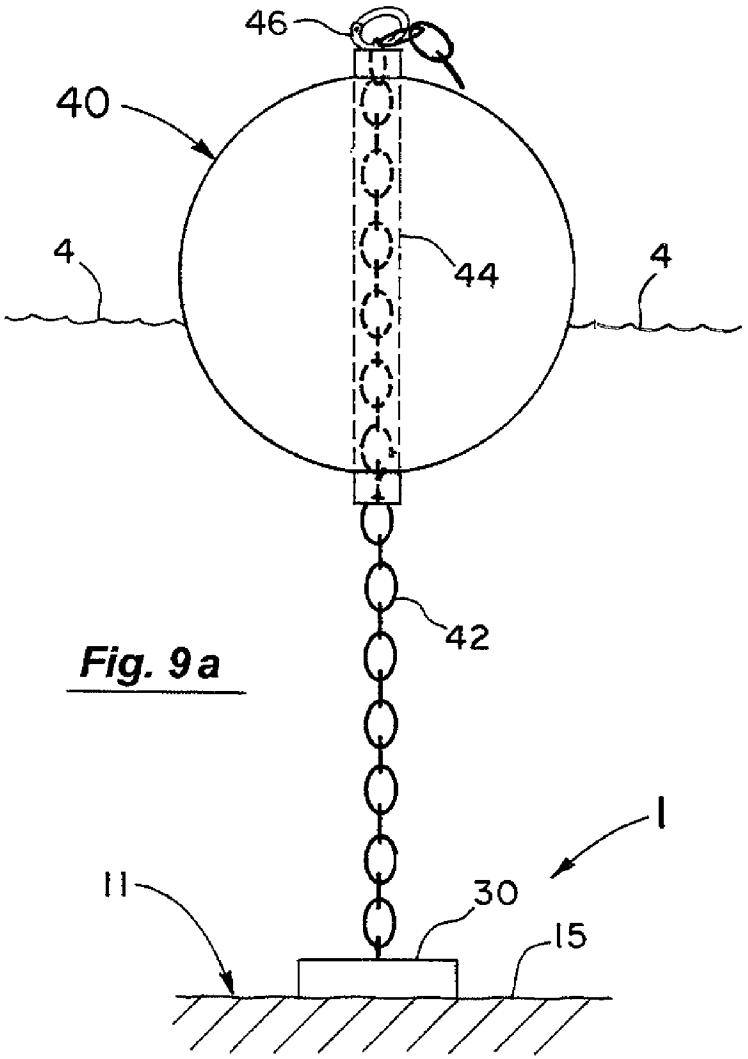

The depth of the submerged driving unit 1 of FIG. 8 can be adjusted if desired as shown in FIGS. 9*a* and 9*b* by varying the effective length of the chain 42. That is, more or fewer links of the chain 42 can be drawn up through the central pipe 44 of the float 40 and clipped in place at 46 as desired. The clip 46 as shown in FIGS. 9*a* and 9*b* is of a larger diameter than the pipe 44 and can be clipped to any link in the chain 42 to act as a downward stop to set the effective length of the chain 42 and the depth of the driving unit 1.

Figure 7:
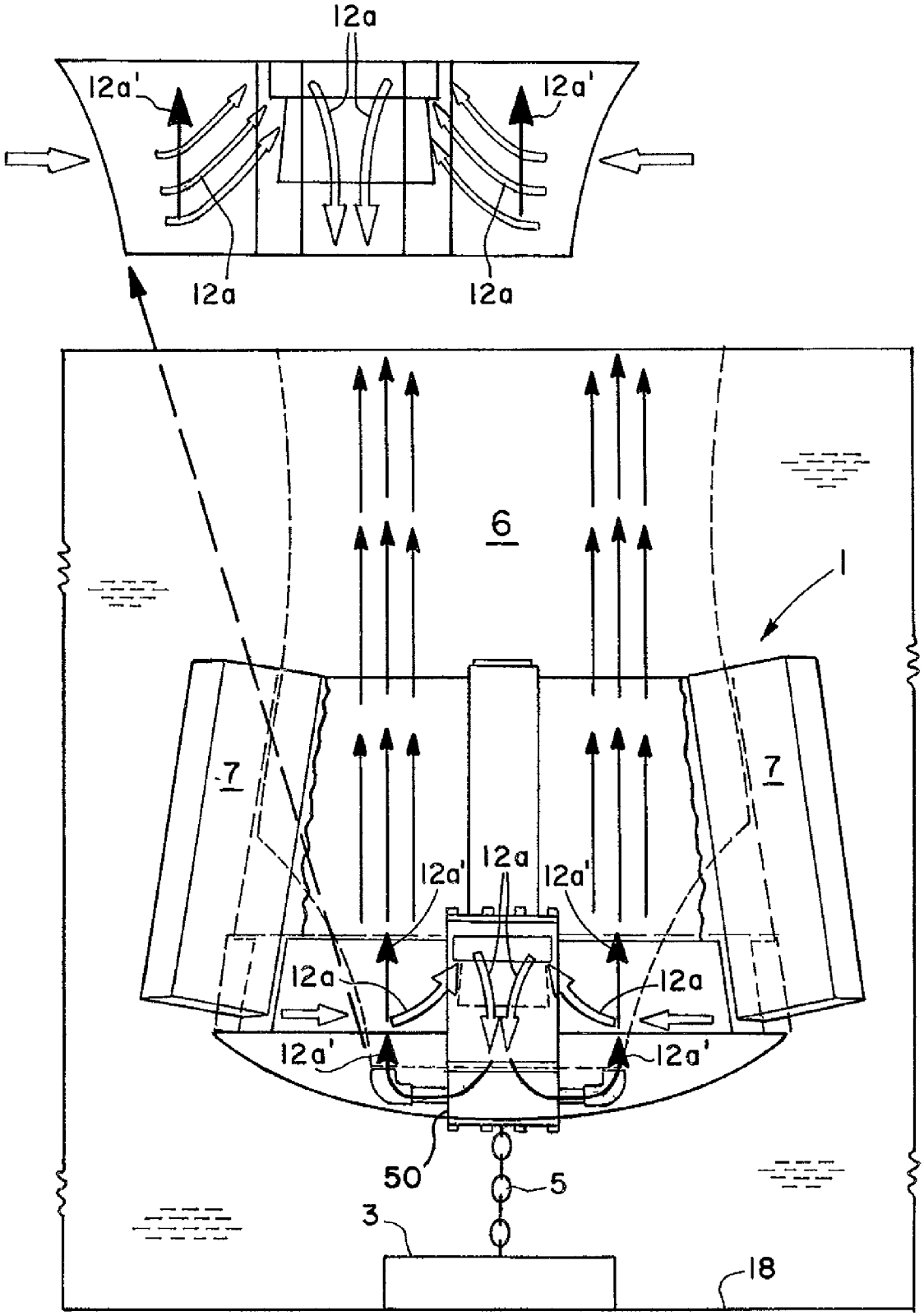
FIG. 7 further illustrates the operating parts and flows of the driving unit.
Figure 10B:
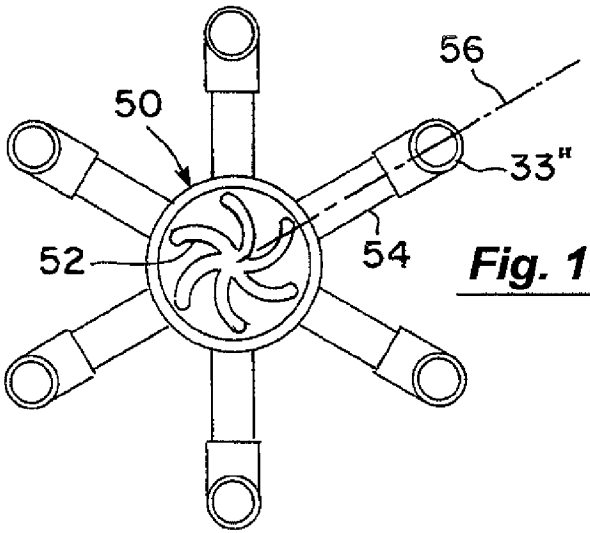
FIGS. 10*a*-10*d* illustrate various nozzle configurations for the pump outlet of the driving unit of the circulation system.
Figure 10D:
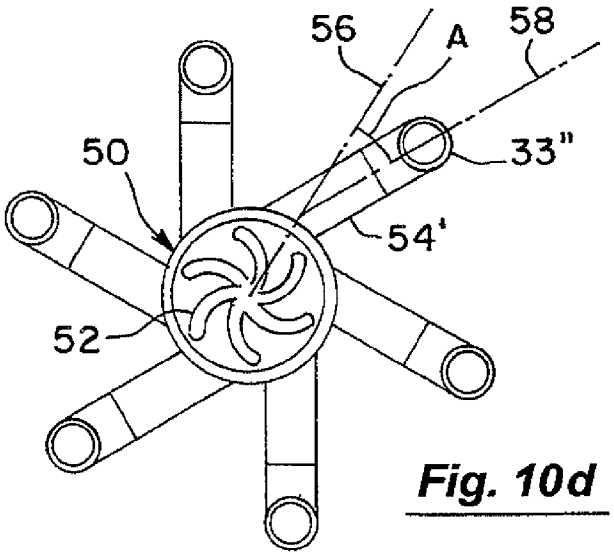
Figure 10A:
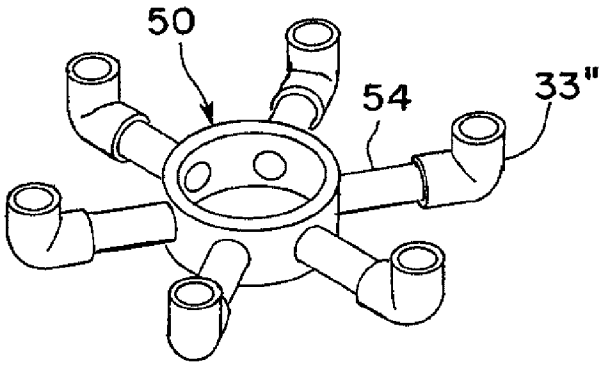
Figure 10C:
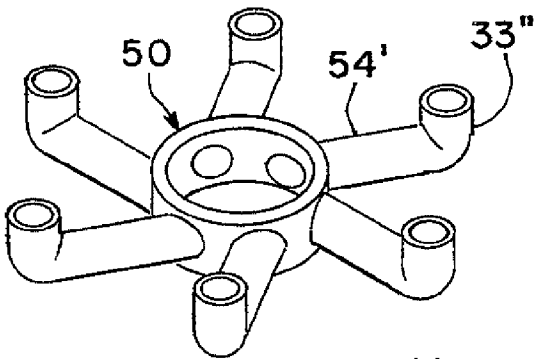

FIGS. 10*a*-10*d* show two embodiments of the outlet arrangement of the pump 33. In both embodiments, the outlet arrangement includes a substantially annular manifold 50 (see also FIGS. 6 and 7) and rotating vane members 52 (FIGS. 10*b* and 10*d*) positioned in the manifold 50. In the embodiment of FIGS. 10*a*-10*b*, the connecting pipe portions 54 from the manifold 50 to the nozzles 33" extend along axes 56 that are projected radii of the annular manifold 50. In the embodiment of FIGS. 10*c*-10*d*, the connecting pipe portions 54' as shown extend along axes 58 in an inclined or tangential fashion at an acute angle A (e.g., 30 degrees) to the projected radii 56 of the annular manifold 50.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims. In particular, it is noted that the word substantially is utilized herein to represent the inherent degree of uncertainty that may be attributed to any quantitative comparison, value, measurement or other representation. This term is also utilized herein to represent the degree by which a quantitative representation may vary from a stated reference without resulting in a change in the basic function of the subject matter involved.

We claim:

1. A submersible, circulation system for a body of water such as a pond, said system including:

a driving unit having a substantially tubular shell member and a base member, said tubular shell member being spaced from and extending about a substantially vertical axis and extending along said vertical axis for a first distance between upper and lower end sections, said upper and lower end sections of said tubular shell member respectively forming upper and lower openings extending about the vertical axis, said base member extending substantially across the lower opening of the tubular shell member and being supported below and spaced therefrom to create at least one inlet therebetween into the driving unit, said system further including a motor and pump supported within said tubular shell member and extending substantially along said vertical axis, said pump having at least one inlet and at least one outlet, said pump inlet being positioned vertically higher than said pump outlet and substantially adjacent the inlet into the driving unit, said pump outlet including a discharge nozzle directed upwardly and substantially along said vertical axis, said discharge nozzle being positioned in said base portion of the driving unit closer to the vertical axis than the inlet into the driving unit wherein with the driving unit of the system including the upper and lower end sections of the tubular shell member submerged below the surface of the body of water, the pump continuously draws an incoming flow of water substantially horizontally from outside the driving unit inwardly through the inlet into the driving unit with a first portion of the continuously incoming flow entering the pump inlet and the pump thereafter driving the first portion out through the discharge nozzle thereof substantially vertically upwardly within the driving unit along the vertical axis past the inlet and through the incoming flow of water wherein the upwardly directed water from the discharge nozzle flows out of the upper opening of the tubular shell member toward the surface of the body of water and induces the remaining portion of the incoming flow of water not drawn into the pump inlet to move upwardly therewith toward the surface of the body of water.

2. The system of claim 1 wherein the tubular shell member is substantially a truncated cone with the upper opening being smaller than the lower opening.

3. The system of claim 2 wherein the tubular shell member between the lower and upper end sections is inclined inwardly toward the vertical axis about 5 to 15 degrees.

4. The system of claim 1 wherein the upper opening of the tubular shell member is substantially circular about the vertical axis.

5. The system of claim 1 wherein said discharge nozzle is positioned beneath said incoming flow of water to direct the flow from the discharge nozzle up through the incoming flow.

6. The system of claim 1 wherein the base member has a perimeter edge extending about the vertical axis substantially in a horizontal plane and said discharge nozzle is positioned in said base member below said horizontal plane.

7. The system of claim 1 wherein the inlet into the driving unit has an upper part and the pump inlet is positioned adjacent said upper part to curve the substantially horizontal incoming flow slightly upwardly adjacent said pump inlet.

8. The system of claim 1 wherein the ratio of the volume of water in the first portion passing through the pump and the remaining portion induced to flow upwardly therewith is at least 1:2.

9. The system of claim 8 wherein said ratio is at least 1:5.

10. The system of claim 1 wherein said discharge nozzle is one of a plurality of discharge nozzles spaced from each other about the vertical axis and directed upwardly substantially along said vertical axis.

11. The system of claim 10 wherein said inlet into the driving unit is one of a plurality of inlets spaced from each other about said vertical axis.

12. The system of claim 1 wherein said inlet into the driving unit is one of a plurality of inlets spaced from each other about said vertical axis.

13. The system of claim 1 further including at least one float attached to said tubular shell member and at least one anchor attached to the base member and extending downwardly therefrom to the bottom of the body of water.

14. The system of claim 13 wherein the anchor extends a distance downwardly from the base member and said distance is adjustable to selectively position the driving unit of the system at different depth locations between the bottom and surface of the body of water.

15. The system of claim 13 wherein said tubular shell member has interior and exterior surfaces extending about the vertical axis and said float is attached adjacent to the exterior surface thereof.

16. The system of claim 13 wherein said tubular shell member has interior and exterior surfaces extending about the vertical axis and said float is attached adjacent to the interior surface thereof.

17. The system of claim 1 wherein said base member is a substantially dish-shaped, downwardly convex member with said discharge nozzle positioned therein.

18. The system of claim 1 further including at least one surface float attached to the submerged driving unit.

19. The system of claim 18 wherein said surface float has a substantially convex lower surface substantially extending about said vertical axis to deflect the upwardly directed water flowing out of the upper opening of the tubular shell member of the submerged driving unit outwardly about said vertical axis.

20. The system of claim 19 wherein the convex lower surface of said surface float is submerged and the upwardly directed water flowing out of the upper opening of the tubular shell member is unrestricted and forms an unconfined, upwardly directed current in said body of water striking the submerged convex surface of said surface float and being deflected outwardly about said vertical axis.

21. The system of claim 19 wherein the convex lower surface of said surface float is substantially hemispherical.

22. The system of claim 1 wherein said pump outlet includes a substantially annular manifold extending about said vertical axis and a connecting pipe portion extending outwardly therefrom to the discharge nozzle wherein said connecting pipe portion extends outwardly of said annular manifold substantially along a projected radius of said annular manifold.

23. The system of claim 1 wherein said pump outlet includes a substantially annular manifold extending about said vertical axis and a connecting pipe portion extending outwardly therefrom to the discharge nozzle wherein said connecting pipe portion extends outwardly of said annular manifold along an axis intersecting a projected radius of said annular manifold at an acute angle.

24. The system of claim 23 wherein said acute angle is about 30 degrees.

25. A method for circulating water in a body of water such as a pond, said method including the steps of:

(a) providing a submersible driving unit with a substantially tubular shell member extending along and about a substantially vertical axis and having upper and lower openings extending about said vertical axis and a base member extending substantially across the lower opening and spaced below the lower opening to create at least one inlet therebetween into the driving unit, (b) using a pump having at least one inlet and one discharge nozzle with the pump inlet positioned vertically higher than the discharge nozzle to continuously draw an incoming flow of water substantially horizontally from outside the driving unit through the inlet into the driving unit with a first portion of the incoming flow entering the pump inlet and being driven out through the discharge nozzle, and (c) directing the water from the discharge nozzle substantially vertically upwardly within in said driving unit along the vertical axis past the inlet into the driving unit and through the incoming flow of water toward the surface of the body of water to induce the remaining portion of the incoming flow not drawn into the pump inlet to move upwardly therewith toward the surface of the body of water.

26. The method of claim 25 wherein step (b) includes the further limitation of positioning the discharge nozzle beneath the incoming flow of water.

27. The method of claim 25 further including the step (d) of creating a raised, substantially convex mound in the surface of the body of water above the driving unit with the upward flow of step (c) and allowing the raised mound to collapse under gravity to generate a substantially laminar wave outwardly along said surface.

28. The method of claim 27 including the limitation of repeating step (d) to generate a pattern of substantially laminar waves outwardly along said surface.

29. The method of claim 25 wherein step (b) includes the further limitation of providing a plurality of discharge nozzles spaced from each other about the vertical axis and directed upwardly along said vertical axis.

30. The method of claim 25 wherein step (b) includes the further limitation of providing a plurality of inlets into said driving unit spaced from each other about the vertical axis.

31. The method of claim 25 wherein step (b) includes the further limitation of positioning the pump inlet adjacent an upper part of the inlet into the driving unit to curve the substantially horizontal incoming flow slightly upwardly adjacent the pump inlet.

32. The method of claim 25 wherein the ratio of the volume of the first and remaining portions is at least about 1:2.

33. The method of claim 25 wherein in said ratio is about 1:5.

34. The method of claim 25 further including the limitation of providing an anchor attached to the base member and extending downwardly therefrom to the bottom of the body of water.

35. The method of claim 34 wherein the anchor extends a distance downwardly from the base member and said method includes the further limitation of adjusting said distance to selectively position the driving unit of the system at different depth locations between the bottom and surface of the body of water.

36. The method of claim 25 wherein the tubular shell member has interior and exterior surfaces extending about the vertical axis and said method includes the further limitation of providing at least one float attached adjacent to the exterior surface thereof.

37. The method of claim 25 wherein the tubular shell member has interior and exterior surfaces extending about the vertical axis and said method includes the further limitation of providing at least one float attached adjacent to the interior surface thereof.

38. The method of claim 25 further including the limitations of providing a surface float attached to said submerged driving unit having a substantially convex lower surface substantially extending about said vertical axis and positioning the convex lower surface of the surface float to deflect the upwardly directed water from the submerged driving unit outwardly about said vertical axis.

39. The method of claim 38 further including the limitations of submerging the convex lower surface of said surface float and directing the water from the driving unit upwardly in an unrestricted manner forming an unconfined, upwardly directed current in said body of water striking the submerged convex surface of said surface float and being deflected outwardly about said vertical axis.

40. A circulation system for a body of water such as a pond, said system including:

a driving unit submersible below the surface of the body of water and having a substantially tubular shell member and a base member, said tubular shell member being spaced from and extending about a substantially vertical axis and extending along said vertical axis for a first distance between upper and lower end sections, said upper and lower end sections of said tubular shell member respectively forming upper and lower openings extending about the vertical axis, said base member extending substantially across the lower opening of the tubular shell member and being supported below and spaced therefrom to create at least one inlet therebetween into the driving unit, said system including a submersible motor and pump supported within said submerged tubular shell member and extending substantially along said vertical axis, said pump having at least one inlet and at least one outlet, said pump outlet including a discharge nozzle directed upwardly within said tubular shell member and substantially along said vertical axis toward the surface of the body of water, the pump continuously drawing an incoming flow of water substantially horizontally from outside the driving unit inwardly through the inlet into the driving unit with at least a first portion of the continuously incoming flow entering the pump inlet and the pump thereafter driving the first portion out through the discharge nozzle thereof substantially vertically upwardly within the tubular shell member along the vertical axis toward the surface of the body of water, the system further including at least one surface float spaced from and attached to the submerged driving unit wherein the upwardly directed first portion of water flowing vertically out of the tubular shell member is unrestricted and forms an unconfined, upwardly directed current in said body of water, said surface float being positioned in the upwardly directed current and having a submerged, substantially convex lower surface substantially extending about the vertical axis wherein the water in said upwardly directed current strikes said submerged, convex lower surface of the surface float and is deflected outwardly about said vertical axis.

41. A method for circulating water in a body of water such as a pond, said method including the steps of:

(a) providing a submersible driving unit with a substantially tubular shell member extending along and about a substantially vertical axis and having upper and lower openings extending about said vertical axis and a base member extending substantially across the lower opening and spaced below the lower opening to create at least one inlet therebetween into the driving unit, (b) using a pump having at least one inlet and one discharge nozzle to continuously draw an incoming flow of water substantially horizontally from outside the driving unit through the inlet into the driving unit with at least a first portion of the incoming flow entering the pump inlet and being driven out through the discharge nozzle, (c) directing the water from the discharge nozzle substantially vertically upwardly within said tubular shell member along the vertical axis toward the surface of the body of water, (d) providing a surface float spaced from and attached to said submerged driving unit having a submerged, substantially convex lower surface substantially extending about said vertical axis, (e) directing the water from the driving unit upwardly in an unrestricted manner forming an unconfined, upwardly directed current in said body of water, and (f) positioning the submerged convex lower surface of the surface float in said upwardly directed current to deflect the water therein outwardly about said vertical axis.

* * * * *